US008149172B2

(12) United States Patent
Lu et al.

(10) Patent No.: US 8,149,172 B2
(45) Date of Patent: Apr. 3, 2012

(54) ANTENNA

(75) Inventors: Yu-Chun Lu, Taipei (TW); Yi-Cheng Lin, Taipei (TW)

(73) Assignee: National Taiwan University, Taipei (TW)

( * ) Notice: Subject to any disclaimer, the term of this patent is extended or adjusted under 35 U.S.C. 154(b) by 300 days.

(21) Appl. No.: 12/698,724

(22) Filed: Feb. 2, 2010

(65) Prior Publication Data

US 2011/0018782 A1 Jan. 27, 2011

(30) Foreign Application Priority Data

Jul. 21, 2009 (TW) ..... 98124539 A

(51) Int. Cl.
*H01Q 1/38* (2006.01)

(52) U.S. Cl. ..... 343/700 MS; 343/846; 343/767

(58) Field of Classification Search ..... 343/700 MS, 343/846, 848, 702, 767
See application file for complete search history.

(56) References Cited

U.S. PATENT DOCUMENTS 5,337,065 A * 8/1994 Bonnet et al. ..... 343/767
2009/0262028 A1 * 10/2009 Mumbru et al. ..... 343/702

* cited by examiner

*Primary Examiner* — Hoanganh Le

(57) ABSTRACT

An antenna is provided. The antenna includes a substrate, a ground element, a first feed conductor and a second feed conductor. The substrate includes a first surface and a second surface. The ground element is formed on the first surface, wherein the ground element has an aperture, the aperture is funnel shaped, the aperture has an opening portion and a convergent portion, and the opening portion is connected to the convergent portion. The first feed conductor is disposed on the second surface, wherein the first feed conductor feeds a first signal to the aperture. The second feed conductor is disposed on the second surface, wherein the second feed conductor feeds a second signal to the aperture.

19 Claims, 13 Drawing Sheets

ANTENNA

CROSS REFERENCE TO RELATED APPLICATIONS

This Application claims priority of Taiwan Patent Application No. 098124539, filed on Jul. 21, 2009, the entirety of which is incorporated by reference herein.

BACKGROUND OF THE INVENTION

1. Field of the Invention

The present invention relates to a UWB MIMO antenna, and in particular relates to a UWB MIMO antenna with improved signal isolation.

2. Description of the Related Art

Ultra-wideband antenna is an antenna with operation band covering 3.1~10.6 GHz. Conventionally, the Ultra-wideband multi-input multi-output antenna (UWB MIMO) antenna utilizes same-shaped radiators arranged along polarization directions perpendicular to each other to provide Ultra-wideband multi-input multi-output transmission.

FIG. 1*a* shows a conventional UWB MIMO antenna 1. The UWB MIMO antenna 1 comprises a first ground element 10, a second ground element 20, a first radiator 30 and a second radiator 40. The first radiator 30 is partially corresponded to the first ground element 10. The second radiator 40 is partially corresponded to the second ground element 20. The first radiator 30 is disposed along a first direction (Y), and the second radiator 40 is disposed along a second direction (X). The first direction (Y) is perpendicular to the second direction (X). The UWB MIMO antenna 1 transmits signals with perpendicular polarization directions via the first radiator 30 and the second radiator 40.

To isolate the first radiator 30 from the second radiator 40, the distance between the first radiator 30 and the second radiator 40 is increased, which increases the dimensions of the UWB MIMO antenna 1. For such a structure, signal isolation of the conventional UWB MIMO antenna 1 is weak. Specifically, mutual coupling in an operation band is about −15 dB. With reference to FIG. 1*b*, correlation coefficient (computed from S-Parameter) of the UWB MIMO antenna 1 in an operation band is up to 0.06.

BRIEF SUMMARY OF THE INVENTION

A detailed description is given in the following embodiments with reference to the accompanying drawings.

An antenna is provided. The antenna includes a substrate, a ground element, a first feed conductor and a second feed conductor. The substrate includes a first surface and a second surface. The ground element is formed on the first surface. The ground element has an aperture and the aperture is funnel shaped. Also, the aperture has an opening portion and a convergent portion, and the opening portion is connected to the convergent portion. The first feed conductor is disposed on the second surface, wherein the first feed conductor feeds a first signal to the aperture. The second feed conductor is disposed on the second surface, wherein the second feed conductor feeds a second signal to the aperture.

The antenna of the embodiment of the invention has improved signal isolation and reduced signal correlation. Moreover, the structure is simplified, and the dimensions of the antenna are decreased.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

The invention provides a UWB MIMO antenna having an operation band covering 3.1~10.6 GHz.

Figure 1A:
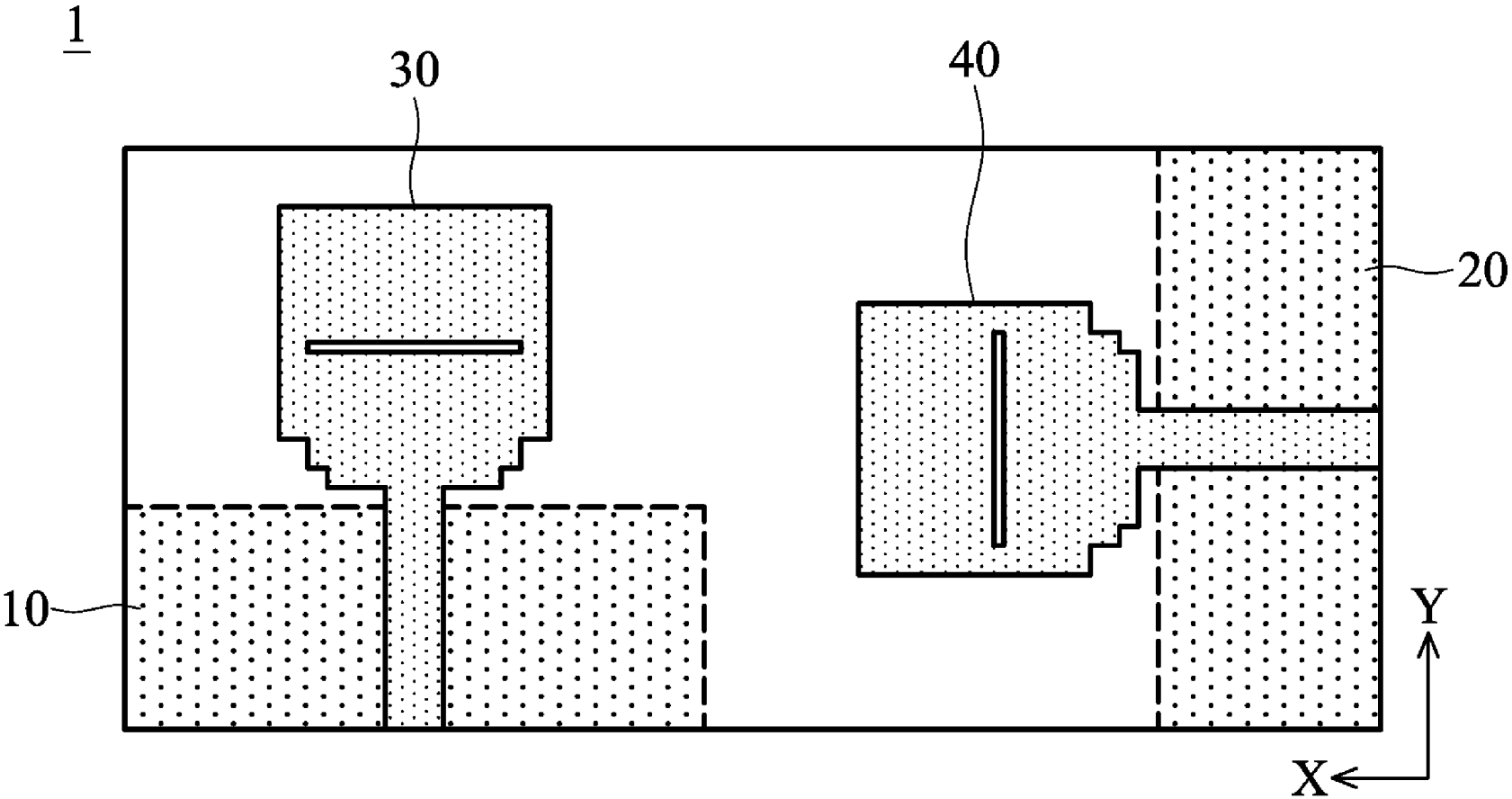
FIG. 1a (PRIOR ART)
FIG. 1*a* shows a conventional UWB MIMO antenna.
Figure 1B:
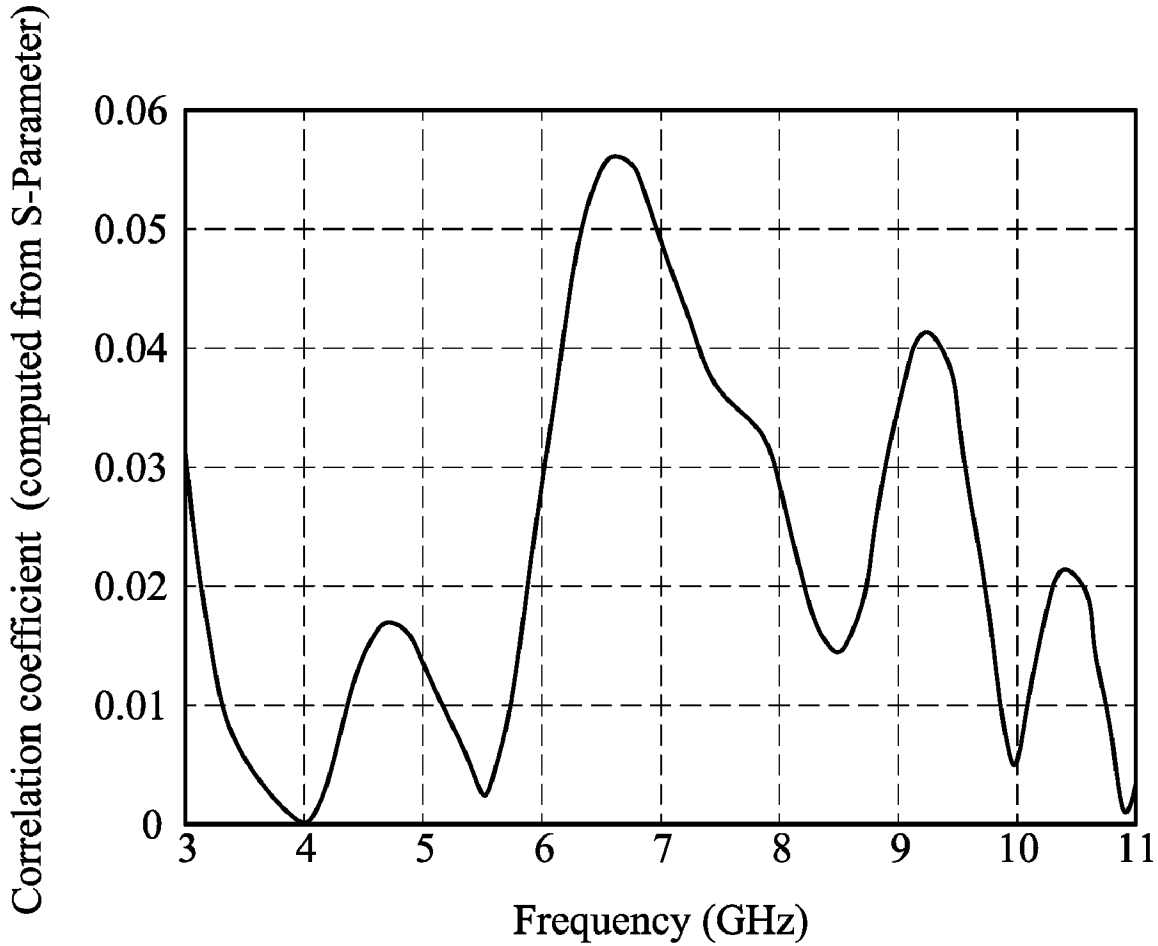
FIG. 1b (PRIOR ART)
FIG. 1*b* shows correlation coefficient (computed from S-Parameter) of the conventional UWB MIMO antenna.
Figure 2A:
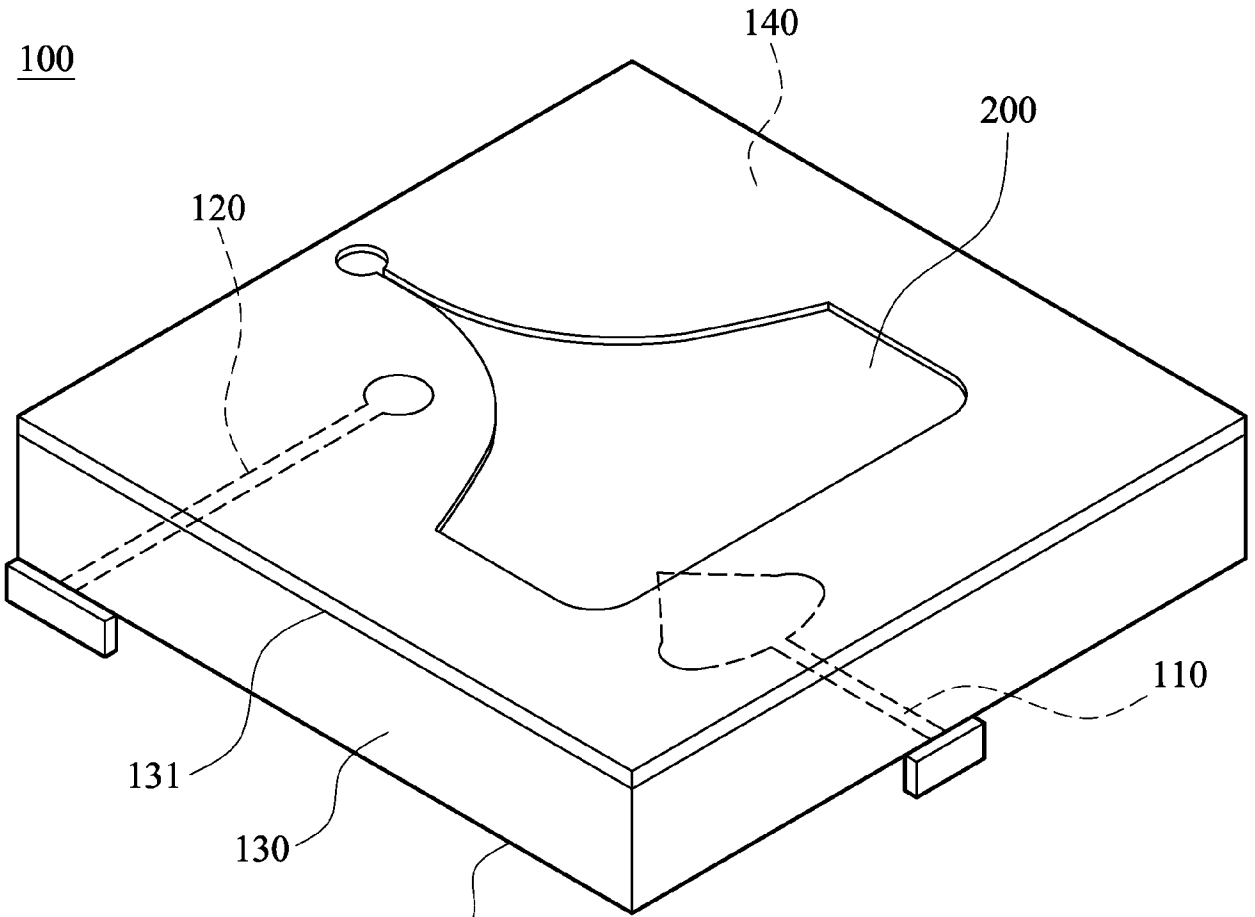
FIG. 2*a* is a perspective view of an antenna of an embodiment of the invention.
Figure 2B:
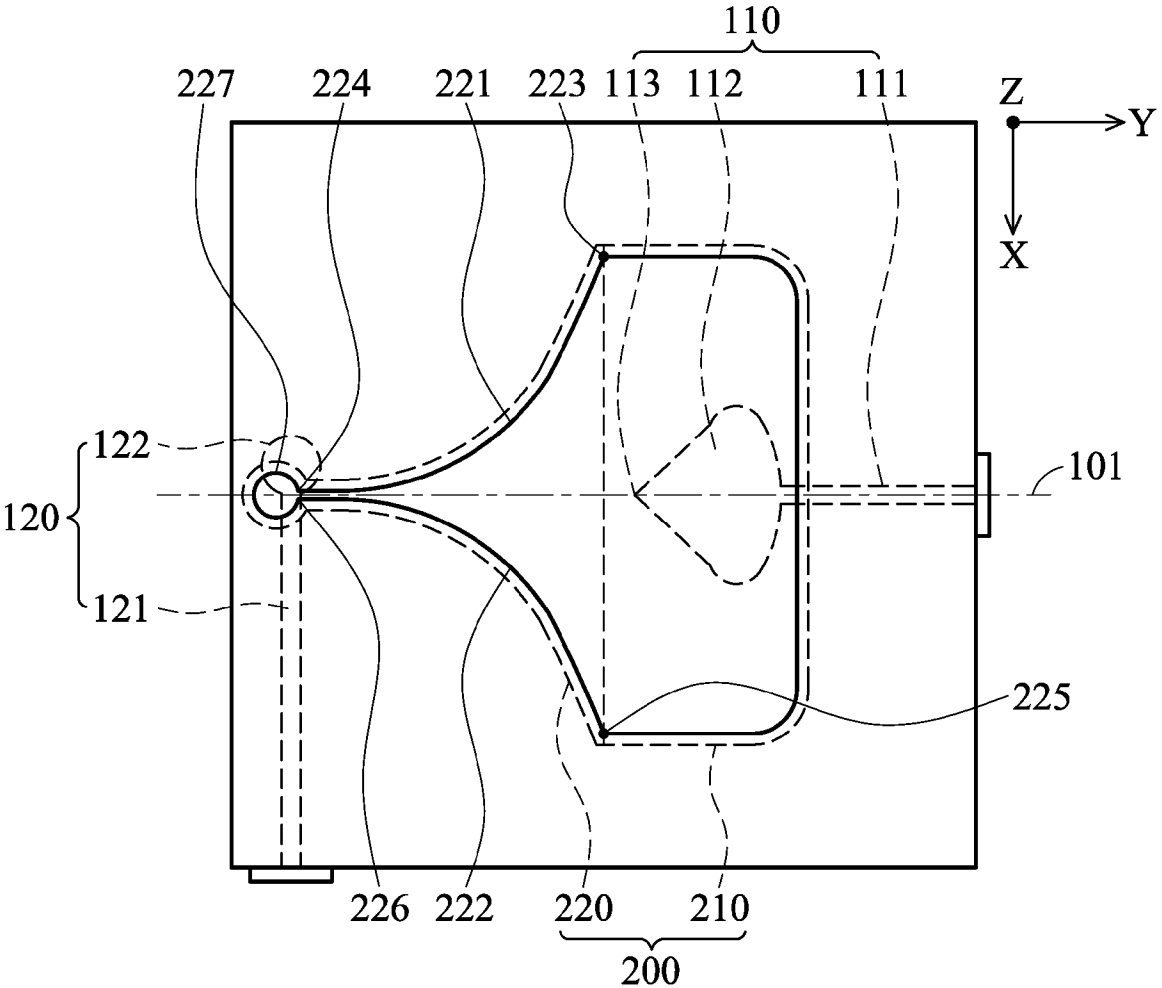
FIG. 2*b* is a top view of the antenna of the embodiment of the invention.

FIG. 2*a* is a perspective view of an antenna of an embodiment of the invention. FIG. 2*b* is a top view of the antenna of the embodiment of the invention. With reference to FIGS. 2*a* and 2*b*, the antenna 100 of the embodiment of the invention comprises a substrate 130, a ground element 140, a first feed conductor (port 1) 110 and a second feed conductor (port 2) 120. The substrate 130 has a first surface 131 and a second surface 132. The ground element 140 is formed on the first surface 131. The ground element 140 has an aperture 200. The aperture 200 is substantially funnel shaped. The aperture 200 has a first portion (opening portion) 210 and a second portion (convergent portion) 220. The first portion 210 is connected to the second portion 220. The first portion 210 is substantially oblong. The second portion 220 has a first curved edge 221 and a second curved edge 222. The first curved edge 221 and the second curved edge 222 extend separately symmetrical to a base line 101. The first curved edge 221 has a first divergent end 223 and a first convergent end 224. The second curved edge 222 has a second divergent end 225 and a second convergent end 226. The first divergent end 223 and the second divergent end 225 are connected to an edge of the first portion 210. The first feed conductor 110 is disposed on the second surface 132, wherein the first feed conductor 110 feeds a first signal to the aperture 200. The second feed conductor 120 is disposed on the second surface 132, wherein the second feed conductor 120 feeds a second signal to the aperture 200.

The first feed conductor 110 is a stub-shaped microstrip line, comprising a first extending portion 111 and a first feed portion 112, the first extending portion 111 is connected to the first feed portion 112, and the first feed portion 112 corresponds to the first portion 210. The first feed portion 112 is water drop shaped, having a tip 113, and the tip 113 is toward the second portion 220.

The second portion 220 further has a feed portion 227. The first convergent end 224 and the second convergent end 226 are connected to the feed portion 227. The feed portion 227 is circular. The second feed conductor 120 is a microstrip line. The second feed conductor 120 feeds the second signal to the feed portion 227. The second feed conductor 120 has a second extending portion 121 and a second feed portion 122, the second extending portion 121 is connected to the second feed portion 122, and the feed portion 227 corresponds to a location where the second extending portion 121 connects the second feed portion 122. The second feed portion 122 is circular. The shape of the feed portion 227 is corresponding to that of the second feed portion 122. For example, when the feed portion 227 is rectangular, the second feed portion 122 is rectangular.

Figure 3A:
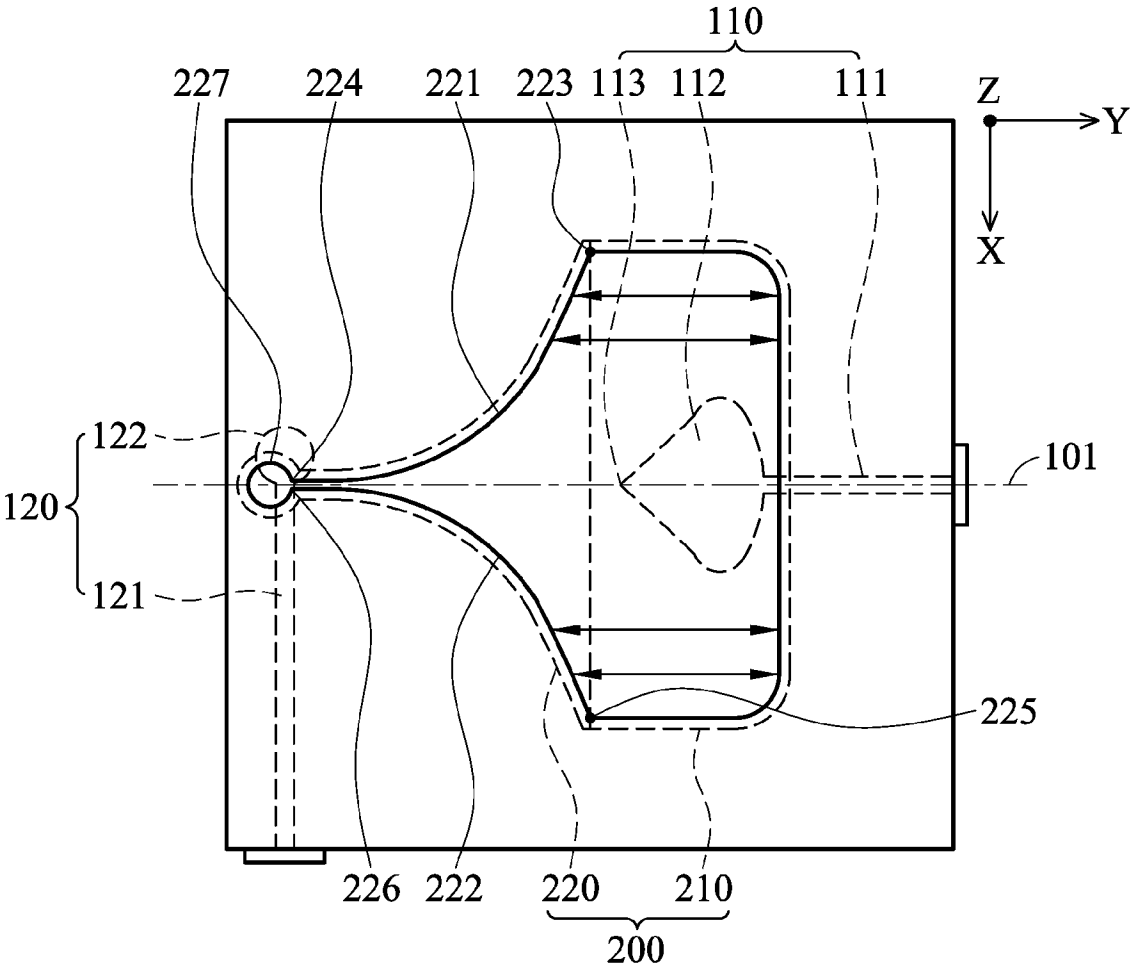
FIG. 3*a* shows the first signal oscillating in the aperture.
Figure 3B:
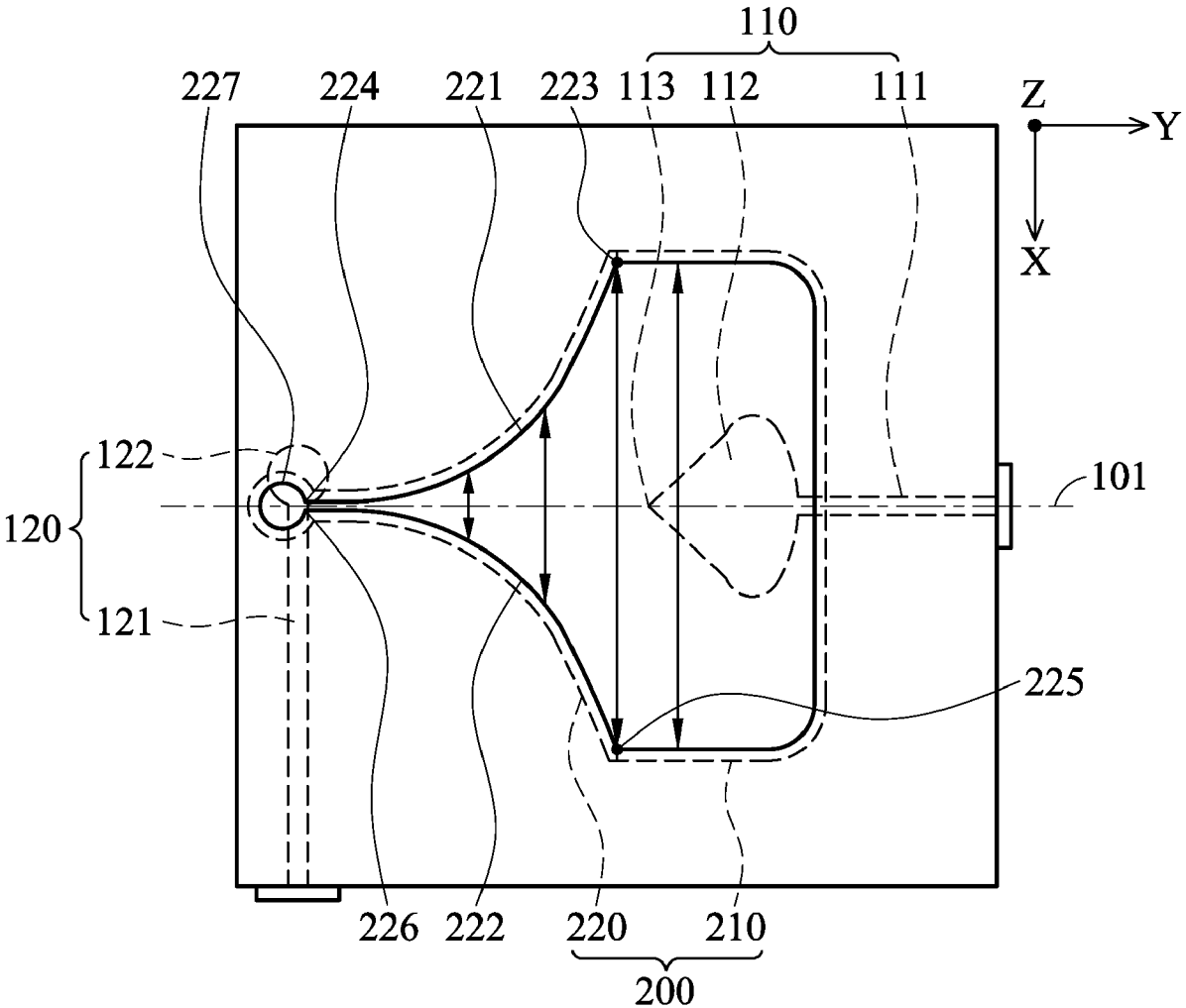
FIG. 3*b* shows the second signal oscillating in the aperture.

With reference to FIG. 3*a*, the first signal oscillates in the aperture along the first direction Y. With reference to FIG. 3*b*, the second signal oscillates in the aperture along the second direction X. The antenna of the embodiment of the invention can transmit singles with different polarization directions.

Figure 4:
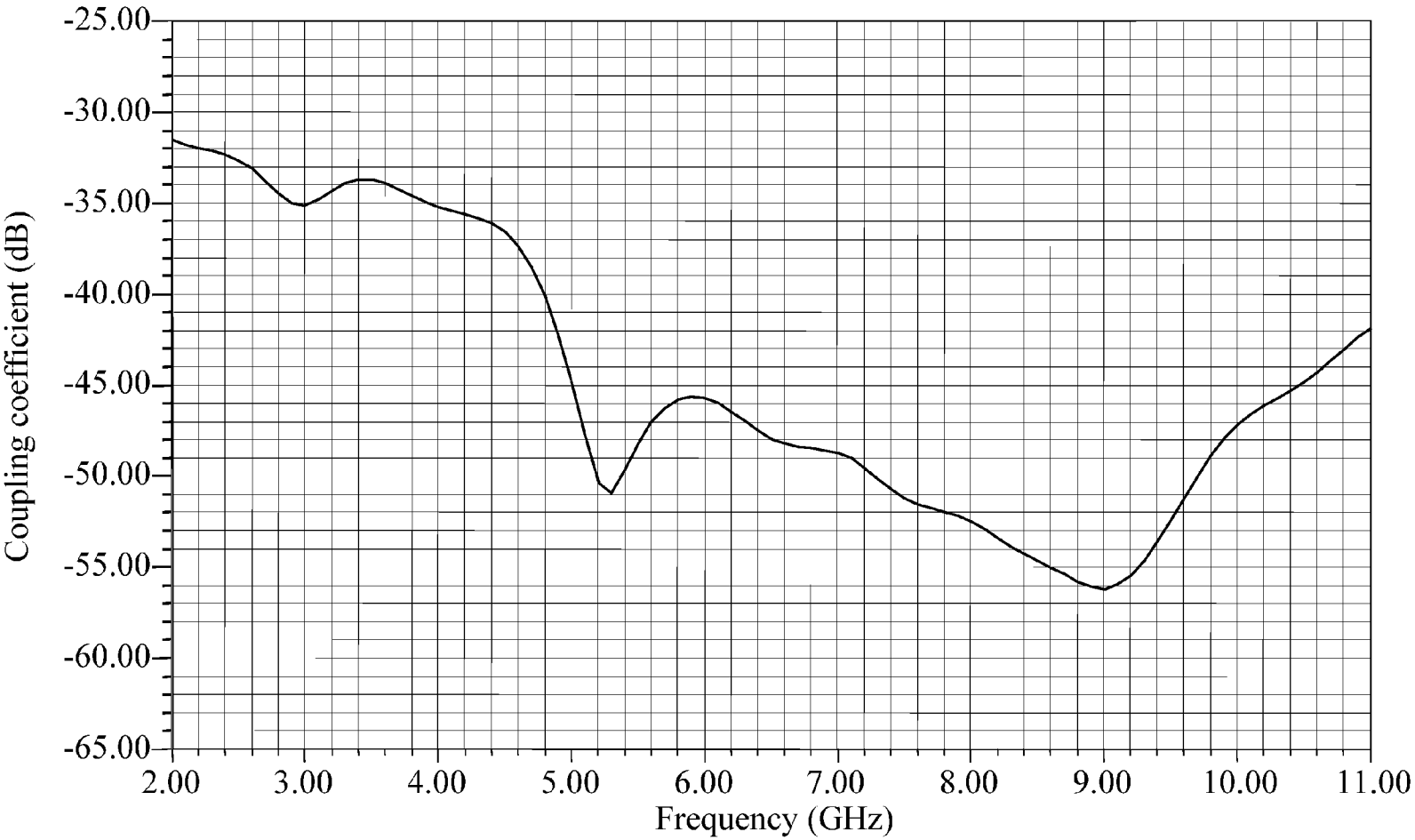
FIG. 4 shows the coupling coefficient (S21) of the antenna of the embodiment of the invention.
Figure 5:
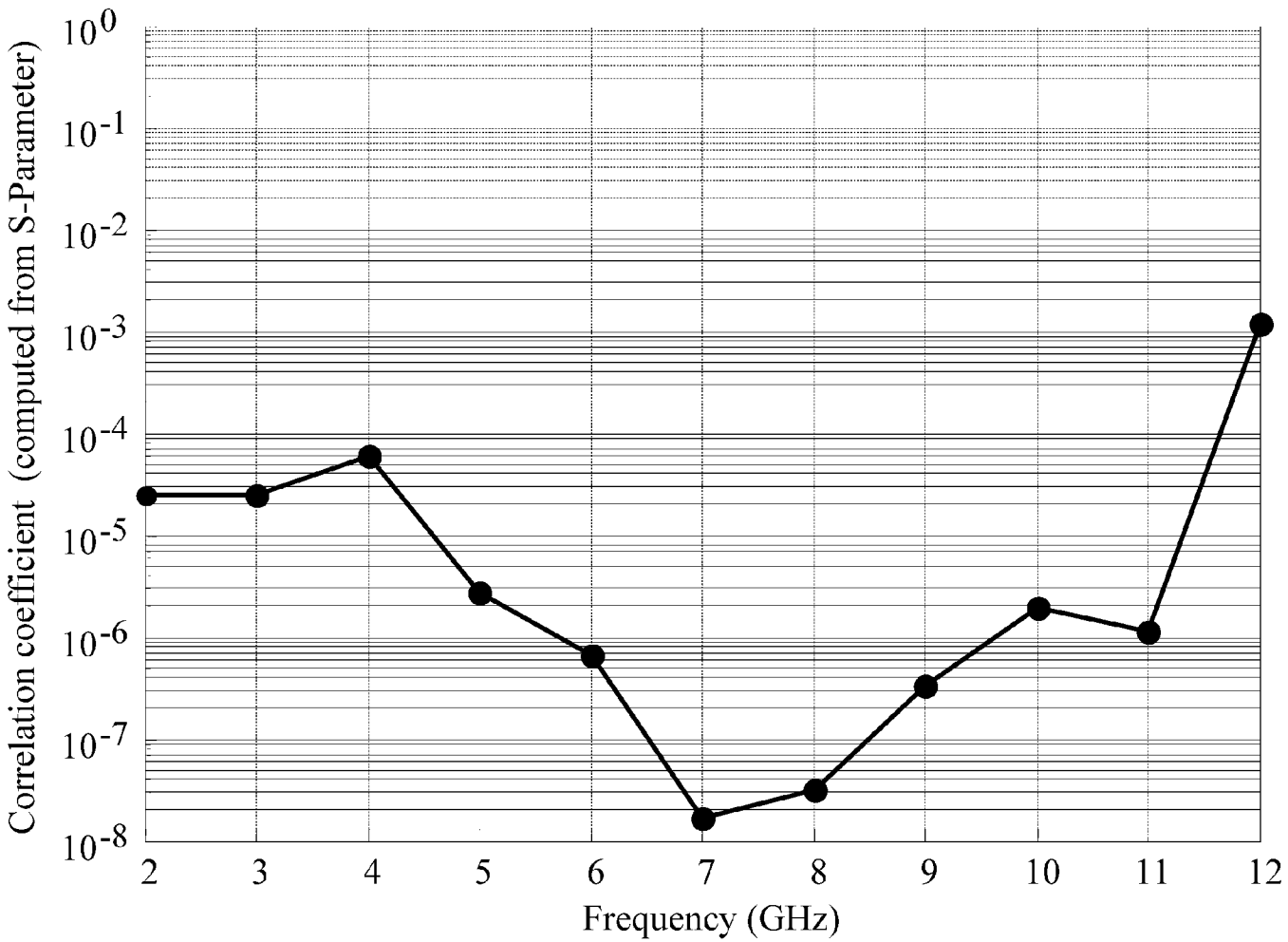
FIG. 5 shows the correlation coefficient (computed from S-Parameter) of the antenna of the embodiment of the invention.

FIG. 4 shows the coupling coefficient (S21) of the antenna of the embodiment of the invention. With reference to FIG. 4, the coupling coefficient (S21) of the antenna of the embodiment of the invention is substantially lower than −32 dB in operation band. FIG. 5 shows the correlation coefficient (computed from S-Parameter) of the antenna of the embodiment of the invention. With reference to FIG. 5, the correlation coefficient (computed from S-Parameter) of the antenna of the embodiment of the invention is substantially lower than $10^{-4}$ in operation band.

Figure 6B:
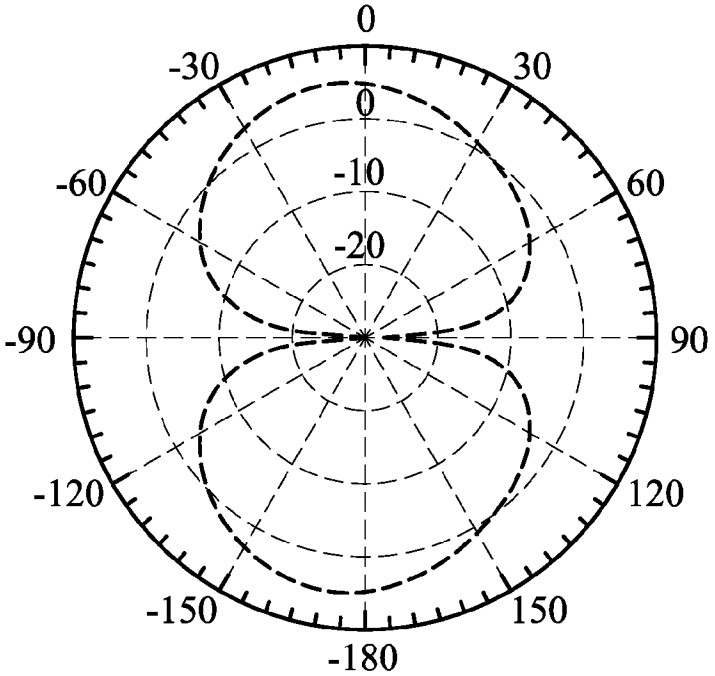
FIG. 6*b* shows the divergence field on a Y-Z plane of the antenna when the first feed conductor feeds the first signal with a frequency of 4 GHz.
Figure 6A:
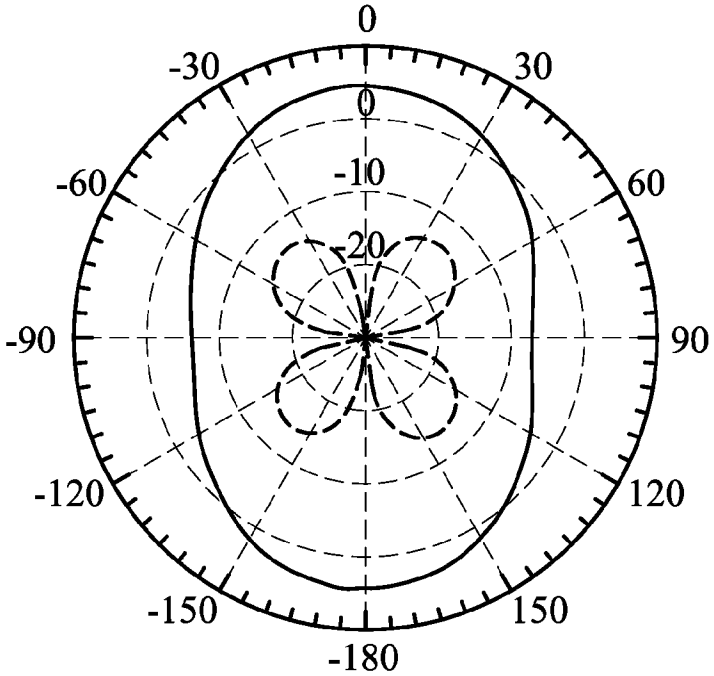
FIG. 6*a* shows the divergence field on an X-Z plane of the antenna when the first feed conductor feeds the first signal with a frequency of 4 GHz.
Figure 6D:
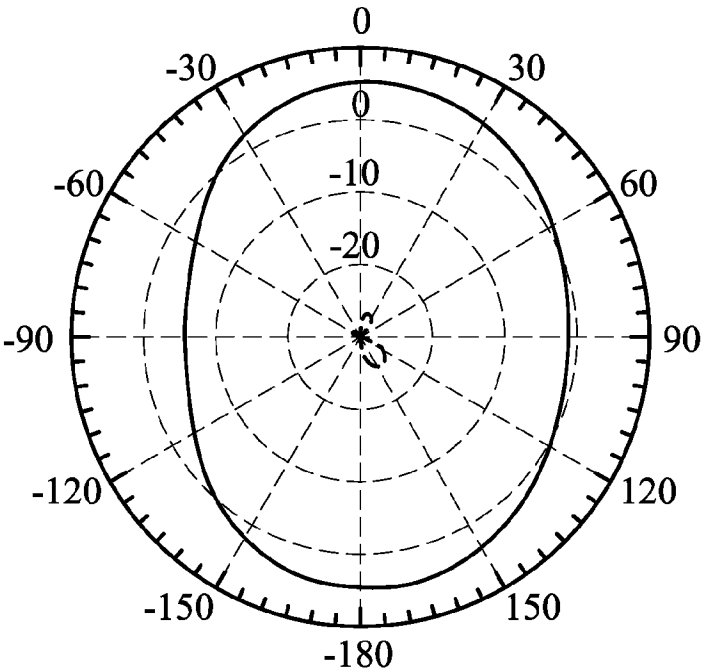
FIG. 6*d* shows the divergence field on a Y-Z plane of the antenna when the second feed conductor feeds the second signal with a frequency of 4 GHz.
Figure 6C:
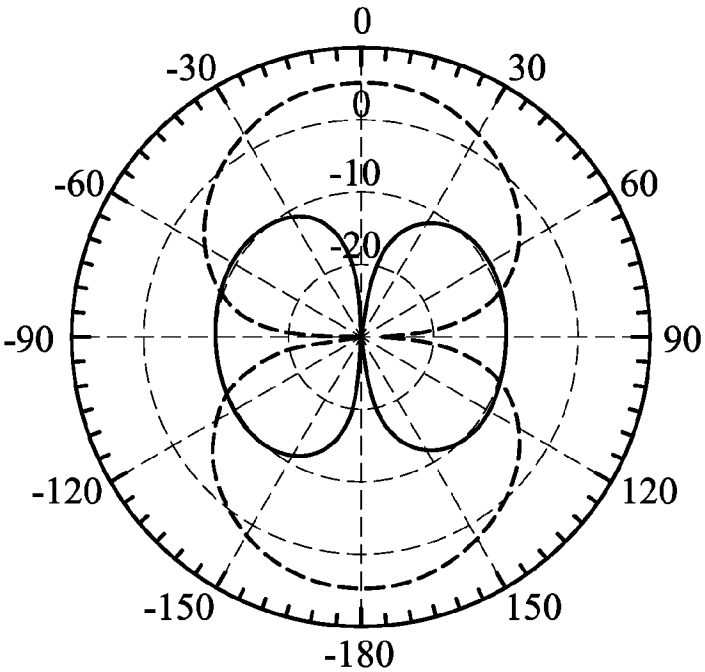
FIG. 6*c* shows the divergence field on an X-Z plane of the antenna when the second feed conductor feeds the second signal with a frequency of 4 GHz.
Figure 6F:
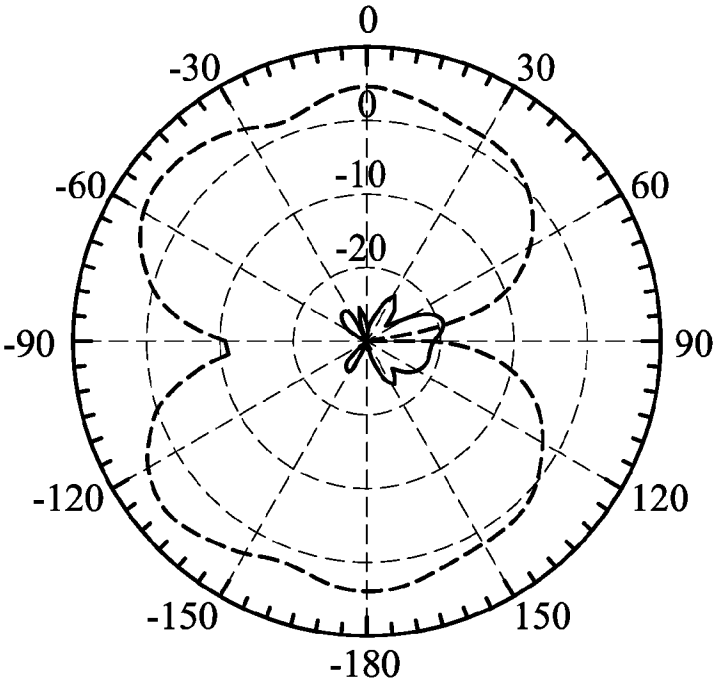
FIG. 6*f* shows the divergence field on a Y-Z plane of the antenna when the first feed conductor feeds the first signal with a frequency of 10 GHz.
Figure 6E:
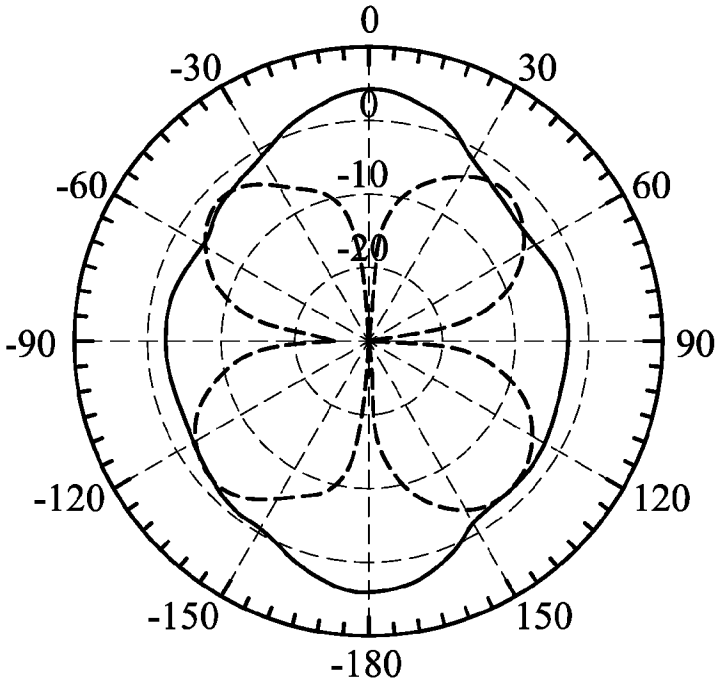
FIG. 6*e* shows the divergence field on an X-Z plane of the antenna when the first feed conductor feeds the first signal with a frequency of 10 GHz.
Figure 6H:
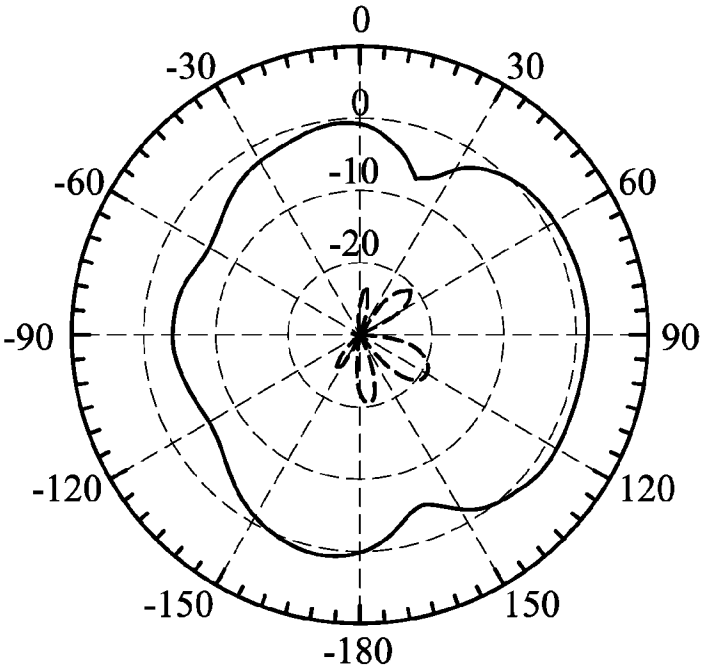
FIG. 6*h* shows the divergence field on a Y-Z plane of the antenna when the second feed conductor feeds the second signal with a frequency of 10 GHz.
Figure 6G:
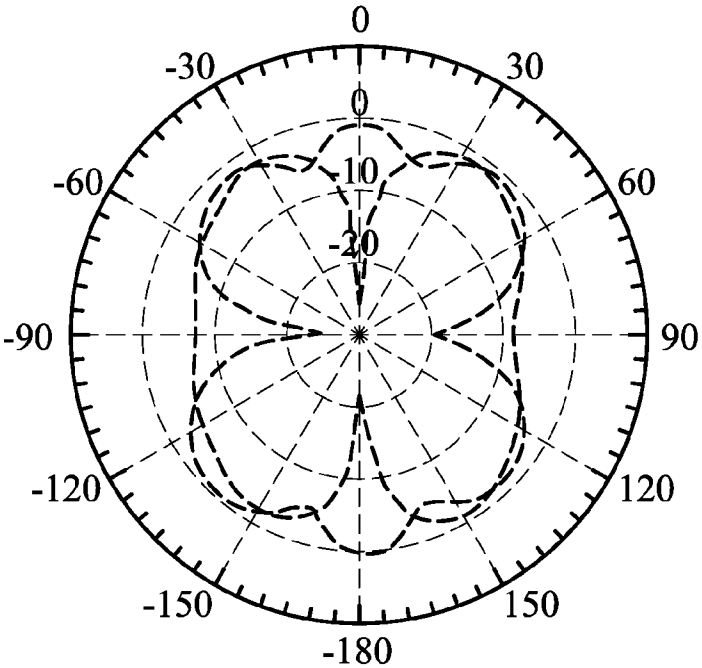
FIG. 6*g* shows the divergence field on an X-Z plane of the antenna when the second feed conductor feeds the second signal with a frequency of 10 GHz.

FIGS. 6*a*-6*d* show divergence fields when the antenna of the embodiment of the invention transmits a signal with a frequency of 4 GHz. FIG. 6*a* shows the divergence field on an X-Z plane of the antenna when the first feed conductor feeds the first signal. FIG. 6*b* shows the divergence field on a Y-Z plane of the antenna when the first feed conductor feeds the first signal. FIG. 6*c* shows the divergence field on an X-Z plane of the antenna when the second feed conductor feeds the second signal. FIG. 6*d* shows the divergence field on a Y-Z plane of the antenna when the second feed conductor feeds the second signal. FIGS. 6*e*-6*h* show divergence fields when the antenna of the embodiment of the invention transmits a signal with a frequency of 10 GHz. FIG. 6*e* shows the divergence field on an X-Z plane of the antenna when the first feed conductor feeds the first signal. FIG. 6*f* shows the divergence field on a Y-Z plane of the antenna when the first feed conductor feeds the first signal. FIG. 6*g* shows the divergence field on an X-Z plane of the antenna when the second feed conductor feeds the second signal. FIG. 6*h* shows the divergence field on a Y-Z plane of the antenna when the second feed conductor feeds the second signal. As shown in FIGS. 6*a*-6*h*, the antenna of the embodiment of the invention provides improved polarization diversity and pattern diversity.

Figure 7:
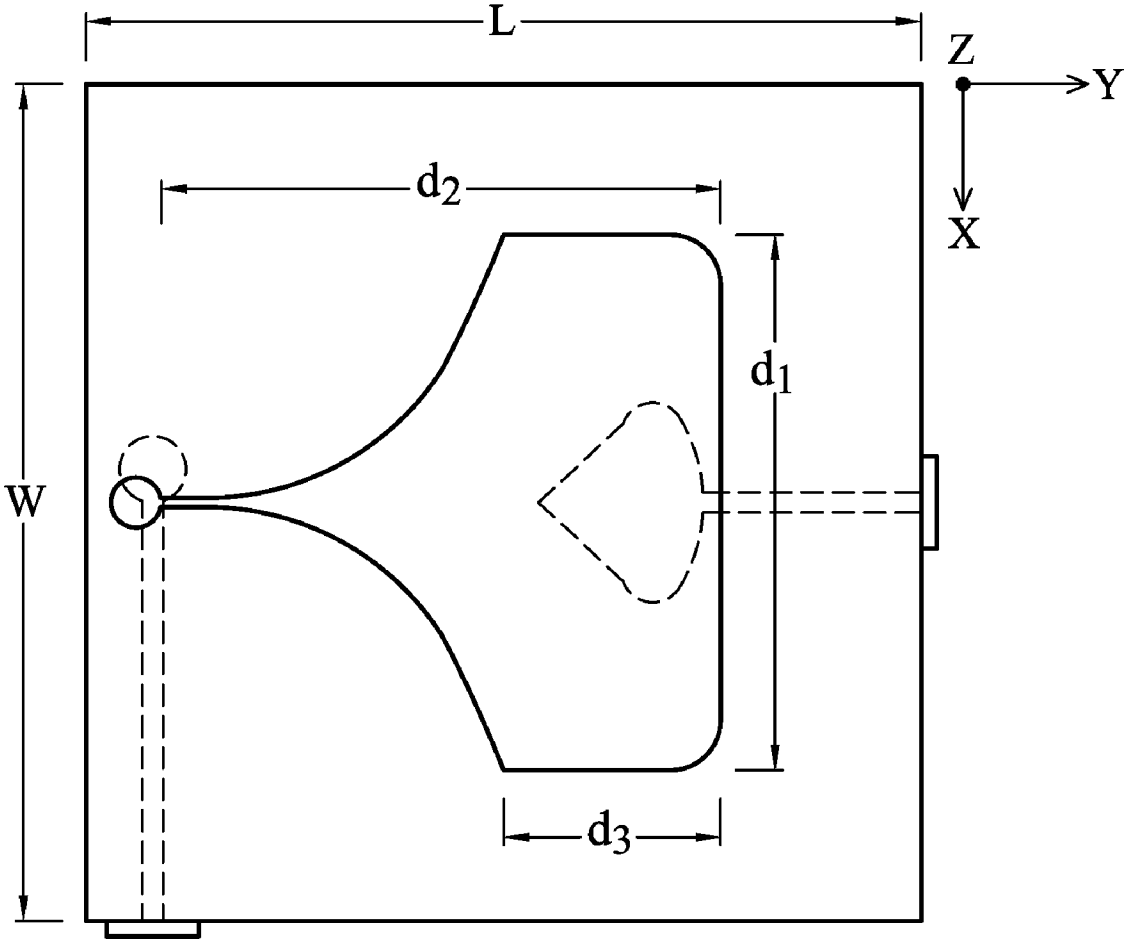
FIG. 7 shows dimensions of the elements of the antenna of the embodiment.

FIG. 7 shows dimensions of the elements of the antenna of the embodiment. The substrate has a substrate length L=50 mm and a substrate width W=50 mm. The first portion has a length $d_1$ on the second direction X. The first and second portions have a total length $d_2$ on the first direction Y. The first portion has a length $d_3$ on the first direction Y. The length $d_1$ and the total length $d_2$ are about half of a wave length $\lambda_1$ of a signal of the lowest operation frequency. In this embodiment, the lowest operation frequency is 3.1 GHz, the length $d_1$ is 32 mm, the total length $d_2$ is 33.5 mm, and the length $d_3$ is 13 mm. The lowest operation frequency of the first and the second feed portions can be modified by changing the length $d_3$. Resistance matching of the second feed portion is modified by changing curvature of the first curved edge and the second curved edge. In this embodiment, the second curved edge satisfies the function of $y=0.55\exp(x/5)$. Resistance matching of the first feed portion can be modified by changing the shape of the first feed portion.

The antenna of the embodiment of the invention provides improved signal isolation and reduced signal correlation. The structure of the antenna of the embodiment is simplified, and the volume of the antenna is decreased when compared to conventional art.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna, comprising:

a substrate, comprising a first surface and a second surface;

a ground element, formed on the first surface, wherein the ground element has a aperture, the aperture has a first portion and a second portion, the first portion is connected to the second portion, the second portion has a first curved edge and a second curved edge, the first curved edge and the second curved edge extend separately symmetrical to a base line, the first curved edge has a first divergent end and a first convergent end, the second curved edge has a second divergent end and a second convergent end, and the first divergent end and the second divergent end are connected to an edge of the first portion;

a first feed conductor, disposed on the second surface, wherein the first feed conductor feeds a first signal to the aperture; and a second feed conductor, disposed on the second surface, wherein the second feed conductor feeds a second signal to the aperture.

2. The antenna as claimed in claim 1, wherein the first feed conductor has a first extending portion and a first feed portion, the first extending portion is connected to the first feed portion, and the first feed portion is corresponding to the first portion.

3. The antenna as claimed in claim 2, wherein the first feed portion is water drop shaped.

4. The antenna as claimed in claim 3, wherein the first feed portion has a tip, and the tip is toward the second portion.

5. The antenna as claimed in claim 1, wherein the second portion further has a feed portion, and the first convergent end and the second convergent end are connected to the feed portion.

6. The antenna as claimed in claim 5, wherein the feed portion is circular.

7. The antenna as claimed in claim 5, wherein the second feed conductor feeds the second signal to the feed portion.

8. The antenna as claimed in claim 7, wherein the second feed conductor has a second extending portion and a second feed portion, the second extending portion is connected to the second feed portion, and the feed portion corresponds to a location where the second extending portion connects the second feed portion.

9. The antenna as claimed in claim 8, wherein the second feed portion is circular.

10. The antenna as claimed in claim 1, wherein the first portion is substantially oblong.

11. An antenna, comprising:

a substrate, comprising a first surface and a second surface;

a ground element, formed on the first surface, wherein the ground element has a aperture, the aperture is funnel shaped, the aperture has an opening portion and a convergent portion, and the opening portion is connected to the convergent portion;

a first feed conductor, disposed on the second surface, wherein the first feed conductor feeds a first signal to the aperture; and a second feed conductor, disposed on the second surface, wherein the second feed conductor feeds a second signal to the aperture.

12. The antenna as claimed in claim 11, wherein the first feed conductor has a first extending portion and a first feed portion, the first extending portion is connected to the first feed portion, and the first feed portion is corresponding to the opening portion.

13. The antenna as claimed in claim 12, wherein the first feed portion is water drop shaped.

14. The antenna as claimed in claim 13, wherein the first feed portion has a tip, and the tip is toward the convergent portion.

15. The antenna as claimed in claim 11, wherein the second portion further has a feed portion, and the feed portion is located on an end of the convergent portion opposite to the opening portion.

16. The antenna as claimed in claim 15, wherein the feed portion is circular.

17. The antenna as claimed in claim 16, wherein the second feed conductor feeds the second signal to the feed portion.

18. The antenna as claimed in claim 17, wherein the second feed conductor has a second extending portion and a second feed portion, the second extending portion is connected to the second feed portion, and the feed portion corresponds to a location where the second extending portion connects the second feed portion.

19. The antenna as claimed in claim 18, wherein the second feed portion is circular.

* * * * *